US006640701B2

(12) United States Patent
Hoffjann et al.

(10) Patent No.: US 6,640,701 B2
(45) Date of Patent: Nov. 4, 2003

(54) APPARATUS FOR COMPACTING AND DRAINING MIXED WASTE IN PASSENGER TRANSPORT VEHICLES

(75) Inventors: Claus Hoffjann, Hamburg (DE); Joachim Hoehne, Hamburg (DE); Hans-Juergen Heinrich, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 09/961,220

(22) Filed: Sep. 20, 2001

(65) Prior Publication Data

US 2002/0185016 A1 Dec. 12, 2002

(30) Foreign Application Priority Data

Jun. 7, 2001 (DE) ..... 101 27 479
Jun. 21, 2001 (DE) ..... 101 29 905

(51) Int. Cl.[7] ..... B30B 9/06; B30B 1/00; B30B 15/30

(52) U.S. Cl. ..... 100/110; 100/126; 100/131; 100/190; 100/215; 100/142

(58) Field of Search ..... 100/110, 126, 100/48, 131, 215, 226, 902, 127, 229 A, 137, 142, 190

(56) References Cited

U.S. PATENT DOCUMENTS 3,911,807 A * 10/1975 Birnbaum ..... 100/37
4,009,838 A * 3/1977 Tashman ..... 241/99
4,080,247 A * 3/1978 Malakul ..... 159/17.1
4,444,099 A * 4/1984 Paleschuck ..... 100/127
4,499,824 A 2/1985 Elwing et al.
4,594,942 A * 6/1986 Denneboom ..... 100/137
4,620,479 A * 11/1986 Diamond et al. ..... 100/215
5,096,114 A * 3/1992 Higginbotham ..... 229/117.15
5,124,126 A * 6/1992 Ripp ..... 422/26
5,193,454 A * 3/1993 Bollegraaf ..... 100/142
5,465,660 A * 11/1995 Conti et al. ..... 100/48
6,006,373 A * 12/1999 Hoang ..... 4/431

FOREIGN PATENT DOCUMENTS

DE 2456967 6/1975
DE 3332451 4/1984
FR 2254495 7/1985

* cited by examiner

*Primary Examiner*—Allen Ostrager
*Assistant Examiner*—Jimmy T Nguyen
(74) *Attorney, Agent, or Firm*—W. F. Fasse; W. G. Fasse

(57) ABSTRACT

Catering in a transport vehicle like an aircraft involves collecting mixed waste including solids (e.g. left-over food portions, food wastes, napkins, disposable cutlery) and liquids (e.g. beverage rests), without separation. These wastes are disposed of into an apparatus including a receiving container with a filter and separating element at the bottom, a waste shaft leading into the container, a press arrangement with flap doors, pressure pistons which press the press arrangement and flap doors onto the waste in the container to compact the waste, and a drain and coupling system at the bottom of the container. As the waste is compacted, liquids drain down through the filter, oils and fats are removed by the separating element, and non-oily liquids are removed through the coupling system to the vacuum disposal system or the gray water drain line of the vehicle. A control unit controls the overall operation.

15 Claims, 1 Drawing Sheet

APPARATUS FOR COMPACTING AND DRAINING MIXED WASTE IN PASSENGER TRANSPORT VEHICLES

PRIORITY CLAIM

This application is based on and claims the priorities under 35 U.S.C. §119 of German Patent Application 101 29 905.2, filed on Jun. 21, 2001, and 101 27 479.3, filed on Jun. 7, 2001, the entire disclosures of which are incorporated herein by reference.

FIELD OF THE INVENTION

The invention relates to an apparatus for receiving, intermediately storing, and then compacting a mixed waste in liquid, pasty, and/or solid form, which is accumulated and needs to be disposed of during food service catering and other passenger services in passenger transport aircraft, buses, railroad trains, and ships.

BACKGROUND INFORMATION

In carrying out the food service catering and other passenger services of the passengers in aircraft, ships, trains and other passenger transport vehicles, a diverse mixture of various waste materials or trash is accumulated. Such waste or trash, called passenger service waste herein, includes, for example: left-over portions of beverages and meals; food waste and particularly organic rest materials such as fruit skins and cores, bones, inedible or left-over portions of foodstuffs, coffee grounds, tea bags and the like; non-consumable items such as packaging materials like beverage cartons, cans, and bottles, single use cutlery, and the like; and cleaning aids such as napkins, wiping towelettes, etc.

It is apparent that the overall mixed waste materials contain solid components as well as liquid components in variable proportions and variable compositions. The liquid or semi-liquid components may also contain various chemical compositions, including water-based liquids, alcohol, fats and oils. Generally, the waste materials or trash are coarsely separated into solid waste and liquid waste as the materials are being collected from the passengers. Then, the solid wastes and the liquid wastes are separately directly disposed of, namely the solid wastes are placed directly into solid waste disposal containers, and the liquid wastes are placed directly into liquid waste disposal containers. Separating the waste between solid and liquid in this manner requires extra efforts by the flight attendants or other passenger service personnel, and does not achieve a very thorough separation of liquids from solids, in any event. The disposal process is messy, cumbersome, and time-consuming.

In various different contexts and applications, for example in the food service industry, it is known to use so-called trash compactors for compacting and thereby reducing the storage and disposal volume of various waste materials.

SUMMARY OF THE INVENTION

In view of the above, it is an object of the invention to provide an apparatus by which the collection and disposal of mixed waste materials or trash in connection with the catering and other passenger service of passengers in passenger transport vehicles can be simplified for the passenger service personnel. It is a further particular object of the invention to provide an apparatus for compacting or compressing the mixed waste while draining any liquids being pressed out of the waste, so that the mixed waste may be collected without being separated and may be directly disposed of into the trash compactor apparatus in a mixed state including solids and liquids. It is another object of the invention to provide for the separation of oils and fats from non-oily liquids, and other substances dissolved in the liquid waste, and then disposing of the liquid waste in a liquid waste disposal system of the passenger transport vehicle. The invention further aims to avoid or overcome the disadvantages of the prior art, and to achieve additional advantages, as apparent from the present specification.

The above objects have been achieved according to the invention in an apparatus for compacting and draining mixed waste materials in a passenger transport vehicle, comprising a trash compactor including a pressure piston and a compactor press arrangement, a control unit, and a waste receiving container with a drain and coupling system. The mixed waste collected from passengers in the transport vehicle, including both solid and liquid wastes, is placed into the waste receiving container where it is temporarily stored and accumulated. When the receiving container reaches a preset fill level, or when activated by service personnel, the pressure piston of the trash compactor presses the compactor press arrangement against the waste in the receiving container, so as to compact or compress the waste under the effect of mechanical pressure in one or more directions. During the compaction of the waste, liquid waste components are squeezed out of the solid waste components and drain downwardly through and from the waste under the effect of gravity. The drain and coupling system allows the liquid waste components to be removed, and drained away or disposed of.

A filter unit especially in the form of a filter plate is preferably arranged near the bottom of the receiving container, to allow the solid waste to be pressed or compacted thereagainst, while filtering the liquid waste components downwardly through a filter element thereof, to then be removed through the drain and coupling system. The filter unit may further include, or the apparatus may further comprise, a separator element for separating oils, fats, or other dissolved substances out of the pressed liquids. The drain and coupling system may be selectively connected to a gray water drain line or to a vacuum disposal system of the passenger transport vehicle.

The gray water drain line is a pipe or conduit through which gray water is drained and disposed of from the passenger transport vehicle, for example being simply discharged to the environment outside of the vehicle. Gray water is the used water that drains from the drinking water system, and from wash basins or the like, whereby this gray water is only slightly soiled or loaded with waste, for example with soaps, detergents, soil from hand washing and the like, but does not include contaminants such as septic wastes (feces, etc.). The gray water is one component of the overall waste water, which is water contaminated with all manner of wastes, residues, septic waste materials (e.g. urine and feces), etc.

Passenger transport vehicles such as aircraft and ships are typically equipped with a gray water system and a waste water system for collecting, storing and ultimately disposing of the gray water and the other waste water. For example, such passenger transport vehicles are often typically equipped with a vacuum disposal system that applies a vacuum to suck the waste water from toilets or the like into an on-board waste water storage tank. The suction is generated, either by the pressure difference between the pressurized cabin and the reduced pressure outside of an aircraft at high flight altitudes, or by a vacuum generator at ground level or at low flight altitudes.

A flush valve is typically provided to close off the inlet of the vacuum disposal system, for example in a toilet or the like, or the gray water drain line relative to the cabin, until a drain and flushing process is initiated, whereupon the flush valve opens to vacuum-dispose or drain the respective waste water.

The waste receiving container of the present inventive apparatus is preferably arranged in or below a waste disposal shaft or chute into which the waste material may be conveniently dropped. The compactor press arrangement especially includes flap doors that pivot downwardly to open from the waste disposal shaft into the waste receiving container. When these flap doors are pivoted upwardly, they are locked or braced in a fixed manner in a horizontal closed position, to act as a press platen which is then pressed downwardly onto the accumulated waste material by the pressure piston(s) of the compactor arrangement so as to compact the accumulated waste material in the receiving container. The receiving container may be supported by strong compacting chamber walls, to withstand the compacting forces. The waste disposal shaft always remains accessible and ready to receive waste being disposed therein, even while a compacting cycle is being carried out. The apparatus thus operates very efficiently, does not disrupt or hinder the service personnel from carrying out the ordinary waste collection and disposal, and does not require waiting periods in the waste collection and disposal process, even though it operates in a batch compacting manner.

The invention achieves at least the following advantages.

A separate collection and disposal of liquid and solid waste materials or trash is no longer necessary, thereby simplifying the waste collection process for the service personnel.

The liquid components and other materials dissolved in the liquid components are removed very effectively from the solid components by means of pressing, filtering and/or sorption. The liquid components can be conveniently disposed of through the vacuum disposal system or the gray water drain line that are already provided in the passenger transport vehicle. In the event a vacuum disposal system is not available, or fails, the present inventive apparatus can continue to be used fully effectively through the connection to the gray water drain line.

The connections to the vacuum disposal system or the gray water drain line may alternatively be carried out through a standpipe or riser pipe without drip protection, or a ground connection with drip protection.

Compression or compaction of the solid waste materials results in a reduction of the volume thereof, and simultaneously effectively removes the liquid components.

Depending on the waste mixture that is intended to be collected and received, a filter element having different filtering characteristics can be correspondingly provided, for example, for filtering out sugars, coloring agents, etc. Moreover, oils and fat can be separated out of the liquid component of the waste, to avoid clogging or contamination of the gray water drain line or the vacuum disposal system by the accumulation of such oils and fats.

The positive separation of the receiving container from the vacuum disposal system and the gray water drain line by associated valves, assures that bacteria, fungi, and various germs that arise in the vacuum disposal system will be positively kept out of the trash compacting apparatus.

Since the trash or waste material is compacted in a replaceable or exchangeable receiving container, the disposal of the solid waste component compacted into this container is fast and simple, by the rapid exchange of the full receiving container by a new empty receiving container. This rapid exchangeability of the receiving container is especially facilitated by a quick connector element between the drain outlet of the receiving container and the vacuum disposal system or the gray water drain line. The quick connector may be any commercially available quick connector suitable for this purpose.

The filter element further provides protection against the introduction of solid waste or other solid materials into the vacuum disposal system or the gray water drain line, which could lead to plugging or damage of this system.

The loading flap doors of the disposal apparatus are configured and embodied in such a manner, that all waste materials are simply placed into the disposal shaft and from there they pass entirely and exclusively into the waste collecting and receiving container.

Due to the volume reduction of the waste material and the removal of the liquid component into the vacuum disposal system, the waste disposal load is reduced, thereby achieving an environmentally friendly waste disposal system.

The operation of the apparatus is very simple or can be entirely automated through the use of corresponding flush valves and a control unit for controlling and monitoring the sequential progression of all functions. The control unit is connected to the waste compactor press by a control signal conductor, to control the operation of the waste compactor press.

Convenient cleaning of the compactor arrangement can be achieved by providing an access port for a cleaning tool such as a flushing spray wand or a cleaning brush or scraper or the like into the apparatus through the drain and coupling system.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 2:
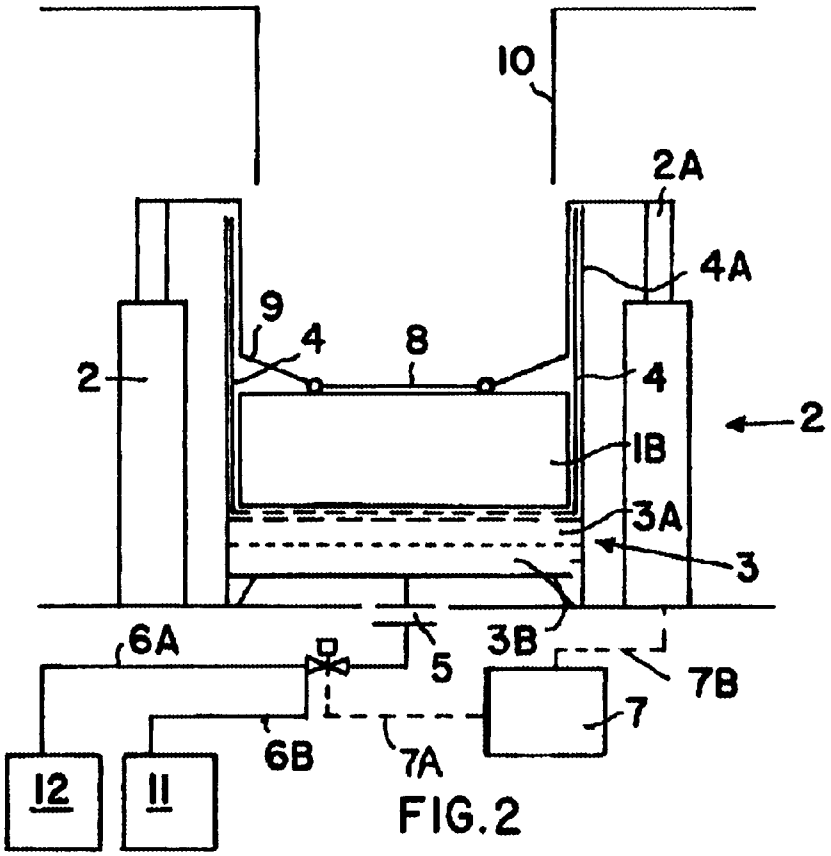
FIG. 2 is a schematic sectional side view similar to FIG. 1, but showing the state after the mixed waste has been compacted and the liquid components have been filtered and drained out.
Figure 1:
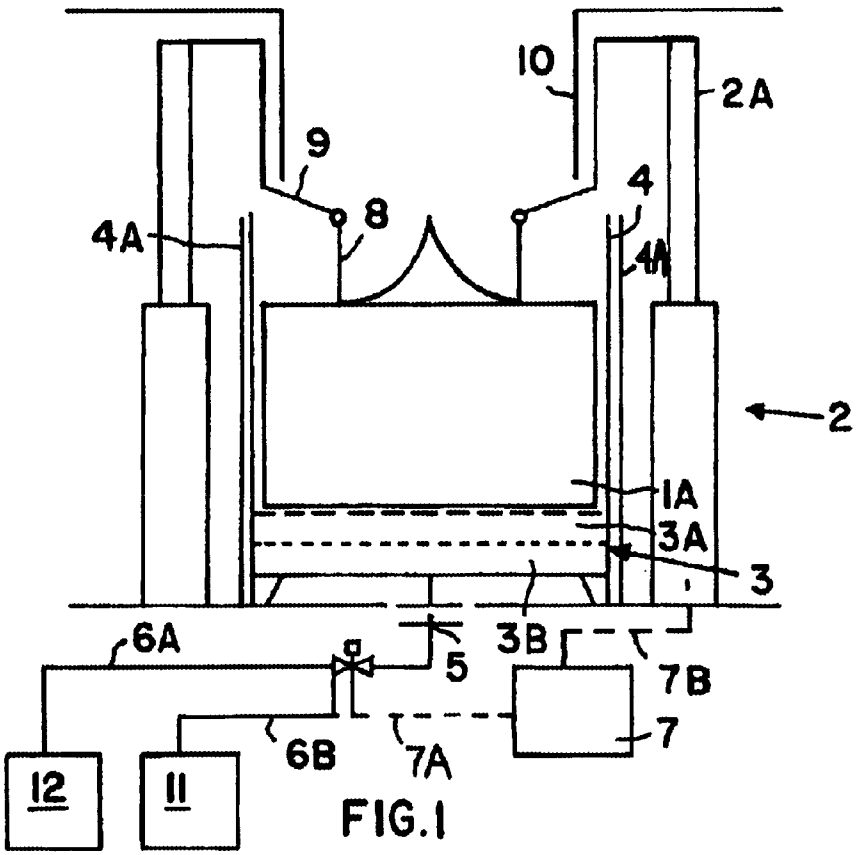
FIG. 1 is a schematic sectional side view of the apparatus according to the invention, with a charge or load of uncompacted mixed waste received in the receiving container.

FIGS. 1 and 2 show a trash compactor apparatus 2 according to the invention, with a removable and replaceable or exchangeable trash receiving container 4 arranged therein. For example, the trash receiving container 4 can be slid into place from a side of the trash compactor apparatus 2, directly below a waste disposal shaft or chute 10, and supported by strong compaction chamber walls 4A. The container 4 serves to receive and accumulate the uncompacted or uncompressed waste materials 1A as shown in FIG. 1, and to hold the compressed and compacted waste materials 1B as shown in FIG. 2. In the uncompressed and uncompacted condition of the waste materials 1A, these include various mixed wastes in solid, pasty, and/or liquid form. In the compressed and compacted state of the waste materials 1B, most of the liquid components have been pressed out of the waste materials, and any void spaces (filled with air or other gases) have been mostly pressed out or compacted.

In order to remove the liquid components as well as oily or fatty components from the compacted waste materials 1B during the compaction process, a filter and separator unit 3 is arranged at the bottom or floor of the container 4. This unit 3 preferably includes a filter 3A that separates the liquid components from the solid components and allows the liquid components to drain downwardly through the filter, as well as a separator 3B that separates oils and fats or other dissolved substances out of the pressed-out liquids, for example by selectively and preferentially absorbing, adsorbing or otherwise retaining the oils and fats while allowing the other liquids to flow through. In the illustrated embodiment, the filter and separator unit 3 also forms a rigid press platen or press grid at the bottom of the receiving container 4, against which the waste 1A, 1B can be compacted.

The filter and separating unit 3 can be a disposable single use filter unit that remains a permanent part of the disposable receiving container 4 (as shown in FIG. 1), and is therefore disposed along with the compacted waste material 1B, which preferably remains as a compacted bundle or bale of waste directly in the disposable receiving container 4. In other words, in this embodiment, the compacted waste 1B, the receiving container 4, and the filter and separator unit 3 are all disposed of together once the container 4 is full of compacted trash.

Alternatively (as shown in FIG. 2), the filter and separator unit 3 can be arranged as a reusable and exchangeable element that is separate or separable from the container 4, for example below the container 4, or even outside of the trash compacting apparatus 2. For example, the filter and separator unit 3 can be removably connected to a component of the trash compacting apparatus 2, such as the walls 4A. In such an embodiment, the unit 3 can be reused for many compaction cycles, and can remain in place as the successive full containers 4 are respectively replaced by new empty containers 4. Then the unit 3 may be cleaned, refurbished or replaced.

The compacting apparatus 2 comprises at least one, but preferably at least two pressure pistons 2A which can be actuated hydraulically, pneumatically, mechanically, magnetically, and/or by means of vacuum, to exert the required compacting force for compacting the waste materials. The pressure pistons 2A are mechanically connected to a compactor press arrangement 9 that reaches below the waste shaft 10 and into the waste receiving container 4. Pivotable flap doors 8 are connected to or form a part of the press arrangement 9, and may be pivoted downward into an open position so that waste can be passed from the waste shaft 10 down through the flap doors 8 into the waste receiving volume of the receiving container 4. On the other hand, when the flap doors 8 are pivoted upwardly into a horizontal position, they are detented, locked or fixed in this position to act as a press platen that can be pressed downwardly by the pressing force applied through the press arrangement 9 from the pressure pistons 2A, so as to press down and compact the waste material from the uncompacted condition 1A to the compacted condition 1B.

Throughout this process, the waste shaft 10 remains open and available for receiving additional waste materials. If additional waste or trash is placed into the shaft 10 while the compacting cycle is being carried out, i.e. the flap doors 8 are closed, then this additional trash will remain temporarily supported on the closed flap doors 8 in the shaft or chute 10, and will thereafter fall down into the receiving container 4 once the press arrangement 9 is again lifted upwardly and the flap doors 8 are opened by pivoting downwardly. In this manner, waste may be continuously disposed of into the waste shaft 10, regardless of the cyclical or batchwise compacting operation of the compacting apparatus 2.

During the compacting operation, i.e. as the press arrangement 9 and the flap doors forming a press platen 8 are pressed downwardly onto the waste material 1B, liquids are pressed out of the waste, and passed downwardly through the filter and separating unit 3. Fats and oils are retained by the separating element 3B, while the non-oily liquids pass down into the bottom of the container 4. The liquids flow to or collect at a drain and coupling system 5, which selectively connects the container 4 to either a vacuum disposal system 6A or a gray water drain line 6B of the transport vehicle. Moreover, this coupling system 5 may include an access port for access by a cleaning device for cleaning out this area of the apparatus.

The drain and coupling system 5 preferably includes a flush valve, e.g. "flush valve assembly" part no. 14330 sold by the Monogram company, for selectively flushing the pressed-out liquids into the vacuum disposal system 6A. The drain and coupling system 5 further or alternatively includes a drain valve, e.g. "water drain valve type FRH 340003 H" for draining the pressed-out liquids into the gray water drain line 6B. Furthermore, the total functional sequence of such a process is controlled by a control unit 7, for example the "flush control unit" part no. 14330-190 of the Monogram company, which is connected to the valve or valves of the drain and coupling system 5 and to the compacting apparatus 2 by respective control signal conductors 7A and 7B for providing control signals thereto.

In this manner, the liquid components of the mixed waste are disposed of into the existing liquid waste disposal systems of the transport vehicle. The liquids drained into the gray water drain line may be drained directly overboard from the vehicle or may be stored in a gray water holding tank 11, together with other gray water. Instead, the liquids pressed-out of the mixed waste can be disposed of into the vacuum disposal system, whereby these liquid waste materials will be collected in an onboard waste water holding tank 12 of the vacuum disposal system, until they can be later removed for proper permanent disposal.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for receiving, storing and compacting passenger service waste in a passenger transport vehicle, comprising:

a waste receiving container adapted to receive therein the passenger service waste including a solid waste component and a liquid waste component;

a waste compactor press including at least one pressure piston device and a press arrangement that is connected to and movably drivable by said at least one pressure piston device, and that reaches into said waste receiving container and is adapted to mechanically press and compact the passenger service waste in said waste receiving container, while pressing at least a pressed-out portion of the liquid waste component out of the passenger service waste;

a drain coupling that is provided at a bottom of said waste receiving container, and that is adapted to selectively drain the pressed-out portion of the liquid waste component out of said waste receiving container;

a control unit that is connected by a control signal conductor to said waste compactor press and that comprises a controller adapted to control operation of said waste compactor press;

a waste receiving shaft that is arranged above said waste receiving container and that remains available to receive more of the passenger service waste therein even when some of the passenger service waste is being compacted in said waste receiving container; and a vacuum disposal system connected to said drain coupling.

2. The apparatus according to claim 1, wherein said pressure piston device comprises a hydraulic, pneumatic or vacuum operated piston and cylinder.

3. The apparatus according to claim 1, further comprising a filter unit including a filter element arranged at said bottom of said waste receiving container, wherein said filter element is adapted to allow the pressed-out portion of the liquid waste component to pass therethrough and drain to said drain coupling, and is adapted not to allow the solid waste component to pass therethrough.

4. The apparatus according to claim 3, wherein said filter unit further includes an oil separating element adapted to separate, remove and retain fats and oils from the pressed-out portion of the liquid waste component.

5. The apparatus according to claim 3, wherein said filter unit is removably connected to said waste compactor press, and is not secured to said waste receiving container, enabling said filter unit to be removed from said waste compactor press and to be exchanged.

6. The apparatus according to claim 3, wherein said filter unit is removably connected to said waste receiving container, enabling said filter unit to be removed from said waste receiving container and to be exchanged.

7. The apparatus according to claim 3, wherein said waste receiving container is a single-use disposable container, and said filter unit is a single-use disposable filter unit that is and remains permanently connected to said waste receiving container.

8. The apparatus according to claim 3, wherein said filter unit forms a press chamber floor that is strong enough to withstand and counter the pressing forces applied by said press arrangement.

9. The apparatus according to claim 1, wherein said press arrangement reaches under said waste receiving shaft into said waste receiving container to press and compact the passenger service waste in said waste receiving container.

10. The apparatus according to claim 1, wherein said press arrangement includes flap doors located under said waste receiving shaft, and wherein said flap doors are pivotable downwardly into an open position providing an open passage therethrough from said waste receiving shaft into said waste receiving container and are pivotable upwardly into a horizontal closed position in which said flap doors are fixed so as to together form a press platen that is adapted to press and compact the passenger service waste in said waste receiving container.

11. The apparatus according to claim 1, wherein said drain coupling includes a flush valve that is connected to said vacuum disposal system and that is adapted to selectively pass the pressed-out portion of the liquid waste through said drain coupling into said vacuum disposal system.

12. The apparatus according to claim 1, further comprising a gray water drain line connected to said drain coupling.

13. The apparatus according to claim 12, wherein said drain coupling includes a water drain valve that is connected to said gray water drain line and that is adapted to selectively pass the pressed-out portion of the liquid waste through said drain coupling into said gray water drain line.

14. The apparatus according to claim 1, wherein said control unit further comprises a flush control unit and is further connected by another control signal conductor to said drain coupling.

15. An apparatus for receiving, storing and compacting passenger service waste in a passenger transport vehicle, comprising:

a waste receiving container adapted to receive therein the passenger service waste including a solid waste component and a liquid waste component;

a waste compactor press including at least one a pressure piston device and a press arrangement that is connected to and movably drivable by said at least one pressure piston device, and that reaches into said waste receiving container and is adapted to mechanically press and compact the passenger service waste in said waste receiving container, while pressing at least a pressed-out portion of the liquid waste component out of the passenger service waste;

a drain coupling that is provided at a bottom of said waste receiving container, and that is adapted to selectively drain the pressed-out portion of the liquid waste component out of said waste receiving container;

a control unit that is connected by a control signal conductor to said waste compactor press and that is adapted to control operation of said waste compactor press; and a waste receiving shaft that is arranged above said waste receiving container and that remains available to receive more of the passenger service waste therein even when some of the passenger service waste is being compacted in said waste receiving container;

wherein said press arrangement includes at least one flap door located under said waste receiving shaft, and wherein said at least one flap door is pivotable downwardly into an open position providing an open passage therethrough from said waste receiving shaft into said waste receiving container and is pivotable upwardly into a horizontal closed position in which said at least one flap door is fixed so as to form a press platen that is adapted to press and compact the passenger service waste in said waste receiving container.

* * * * *